US008006348B2

(12) United States Patent
Ferrari

(10) Patent No.: US 8,006,348 B2
(45) Date of Patent: Aug. 30, 2011

(54) RAPIDLY MOUNTED HINGE WING FOR FURNITURE

(75) Inventor: Adelchi Ferrari, Oggiono (IT)

(73) Assignee: Agostino Ferrari S.p.A, Bergamo BG (IT)

( * ) Notice: Subject to any disclaimer, the term of this patent is extended or adjusted under 35 U.S.C. 154(b) by 256 days.

(21) Appl. No.: 12/320,401

(22) Filed: Jan. 26, 2009

(65) Prior Publication Data

US 2009/0199362 A1 Aug. 13, 2009

(30) Foreign Application Priority Data

Feb. 13, 2008 (IT) ..... MI2008A0229

(51) Int. Cl.
*E05D 5/00* (2006.01)

(52) U.S. Cl. ..... 16/384; 16/383

(58) Field of Classification Search ..... 016/382, 016/383, 384, 324; 411/15, 33, 53, 54, 54.1, 411/55

See application file for complete search history.

(56) References Cited

U.S. PATENT DOCUMENTS

| | | | | |
|---|---|---|---|---|
| 4,361,931 | A * | 12/1982 | Schnelle et al. | 16/252 |
| 5,715,577 | A * | 2/1998 | Lautenschlager et al. | 16/383 |
| 6,073,311 | A * | 6/2000 | Lautenschlager | 16/383 |
| RE37,236 | E * | 6/2001 | Brustle et al. | 16/383 |
| 6,286,186 | B1 * | 9/2001 | Lautenschlager et al. | 16/272 |

FOREIGN PATENT DOCUMENTS

| | | |
|---|---|---|
| EP | 0 610 765 | 8/1994 |
| GB | 2 027 482 | 2/1980 |

* cited by examiner

*Primary Examiner* — Chuck Y. Mah
(74) *Attorney, Agent, or Firm* — Jacobson Holman PLLC

(57) ABSTRACT

A hinge wing includes a cup intended for being fixed in a hole of a furniture component. The wing is provided with a pair of expandable teeth arranged on opposite sides of the cup. The teeth are fixed on an eccentric lever of the wing, by rotating which the teeth are moved in an opposite direction to the direction of insertion of the cup into the respective receiving hole. The wing includes for each tooth a cam that, upon rotation of the eccentric lever, causes the respective tooth to expand against a side wall of the receiving hole of the cup to fix the cup to the furniture component. Each cam is formed with a cam element of yieldable material interposed between a side wall of the cup and the respective tooth.

11 Claims, 5 Drawing Sheets

RAPIDLY MOUNTED HINGE WING FOR FURNITURE

BACKGROUND OF THE INVENTION

1. Field of the Invention

This invention relates to an innovative hinge wing, of the type that is mountable on a furniture component without the need for using tools.

2. State of the Prior Art

The hardware market for furniture has always been sensitive to innovations that enable more rapid and stable fixing of the hardware elements to the wooden panels. In particular, in the case of furniture for the "do it yourself" market so-called "tool-less mounting" (TLM) fixing systems are increasingly appreciated that ensure secure fixing without resorting to any type of tool such as a screwdriver or hammer.

TLM systems have in particular been used for fixing cup-type wings (i.e. those provided with a "box") in the appropriate holes that are traditionally obtained in the wall of the furniture.

Currently known products do however, have intrinsic manufacturing difficulties that are mainly due to the fact that the energy required to achieve fixing of the cup has to be provided by resorting to a minimum movement of movable parts such as cams or levers moved manually.

For example, the hinge wings disclosed in the patents EP 0610765 and GB 2027482 provide for the force necessary for expanding the side jaws of the box being obtained by rotating a lever by 90° that is located on top of the flange of the box. In this short movement, which is quantifiable as 15-20 mm, the hand that exerts the thrust on the lever has to provide all the energy necessary for achieving correct fixing: as can be imagined, this is a situation that is very disadvantageous compared with the traditional type of fixing where the work is performed on two screws that are screwed into the wood with about 3 turns of penetration inside the door. The problem is particularly serious when it is considered that the hinge wing can be applied to materials of different type and resistance, such as chipboard and solid wood: a fixing mechanism for fixing the cup that is sufficient for softer material risks requiring excessive force fixing on a harder material. On the other hand a mechanism that enables sufficient fixing to be obtained with acceptable force on a hard material risks not providing sufficient strength guarantees on a softer material.

An object of the present invention is to remedy the aforesaid drawbacks by providing a hinge wing that is rapidly mountable and is reliable without the need to use tools.

A further object of the invention is to provide a hinge wing that can be applied to a furniture component, obtaining similar strength values on various (more or less hard) materials with minimum variations in the required fixing force.

Another object of the invention is to provide a hinge wing that has a simple and cheap structure.

SUMMARY OF THE INVENTION

In view of this object it was decided to make, according to the invention, a hinge wing comprising a cup intended for being fixed in a hole of a furniture component, the wing being provided with a pair of expandable teeth arranged on opposite sides of the cup, said teeth being fixed on an eccentric lever of the wing, by rotating which the teeth are moved in an opposite direction to the direction of insertion of the cup into the respective receiving hole, the wing comprising for each tooth a cam that, upon rotation of the eccentric lever, causes the respective tooth to expand against a side wall of the receiving hole of the cup to fix the cup to the furniture component, characterized in that each cam is formed with a cam element of yieldable material interposed between a side wall of the cup and the respective tooth.

According to an advantageous aspect of the invention, the cam element is made of plastics.

According to another advantageous aspect of the invention, each cam element is fixable to an external side wall of the cup.

According to a further advantageous aspect of the invention, the wing comprises elastic means acting between each tooth and a flange protruding from the cup of the wing.

According to another advantageous aspect of the invention, said elastic thrusting means comprises for each tooth a thrusting element interposed in use between the tooth and the side wall of the receiving hole of the cup.

According to a further advantageous aspect of the invention, said elastic thrusting element forms one piece with the cam element.

According to another advantageous aspect of the invention, said elastic element is provided with external toothing suitable for being pressed against the side wall of the receiving hole of the cup when the teeth are made to expand by the eccentric lever.

According to a further advantageous aspect of the invention, each tooth is provided with an arm that passes through a flange of the wing, the eccentric lever being articulated on said arm above the flange.

According to another advantageous aspect of the invention, each tooth has a hook-shaped end intended for perforating the wall of the receiving hole of the cup.

According to a further advantageous aspect of the invention, the wing comprises for each tooth thrusting elastic elements acting between a flange of the cup and said hook-shaped end of the respective tooth.

BRIEF DESCRIPTION OF THE DRAWINGS

In order to make clearer the explanation of the innovative principles of the present invention and the advantages thereof over the prior art, with the help of the attached drawings two possible embodiments thereof will be disclosed below by way of non-limiting example. In the drawings.

DETAILED DESCRIPTION OF THE INVENTION

Figure 1:
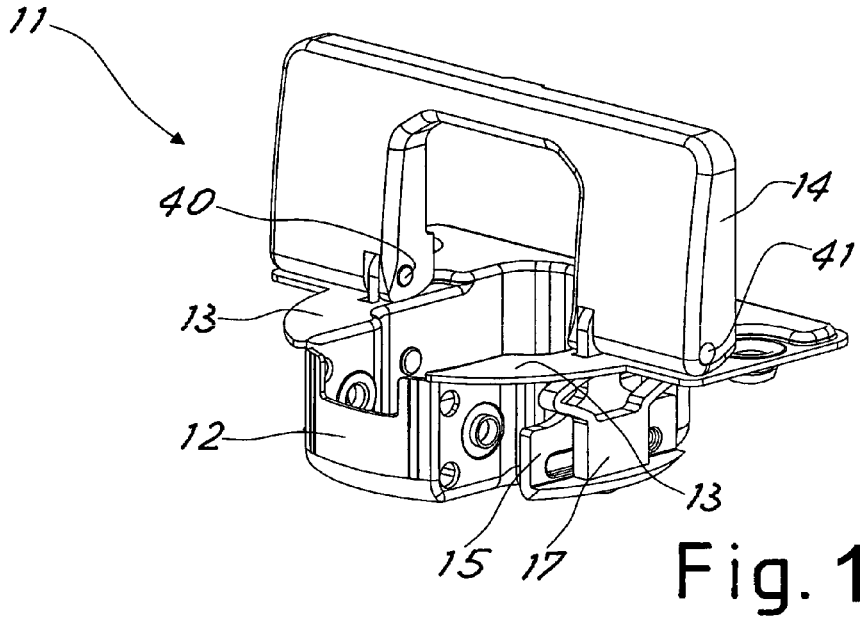
FIG. 1 is a perspective view of a hinge wing according to the present invention with the lever raised for inserting the cup into the hole of the furniture.

With reference to the figures, in FIG. 1 there is shown a hinge wing 11 to be used in a hinge for connecting furniture parts. In the figure the entire hinge is not shown, the hinge being easily imaginable by those skilled in the art and may comprise according to well known teachings a second fixable wing on a second furniture component.

The wing 11 comprises a cup (or box) 12 intended for being inserted into a hole 50 (indicated by a dashed line in FIGS. 3 and 4) obtained in a component of the furniture, for example a movable door wing or a door.

The wing comprises a pair of expandable teeth 15, 16 (also shown clearly in FIGS. 3 and 4) arranged outside the cup 12 on opposite sides thereof.

Figure 2:
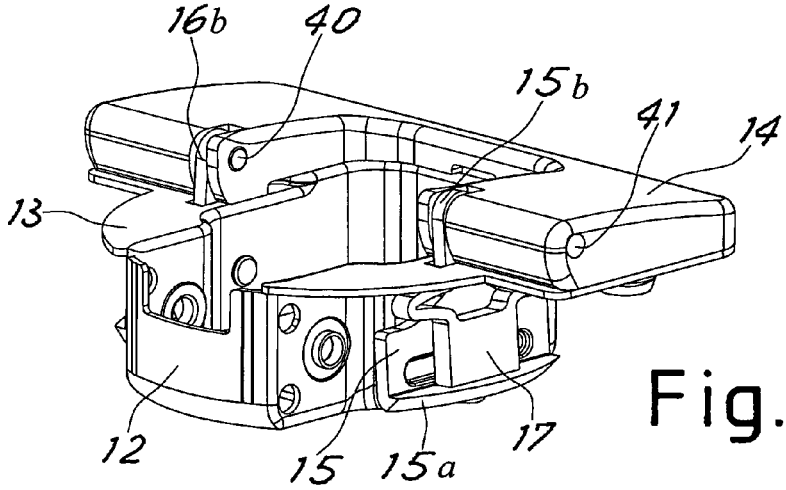
FIG. 2 is a similar view to the preceding view with the lever lowered to clamp on the furniture component.
Figure 9:
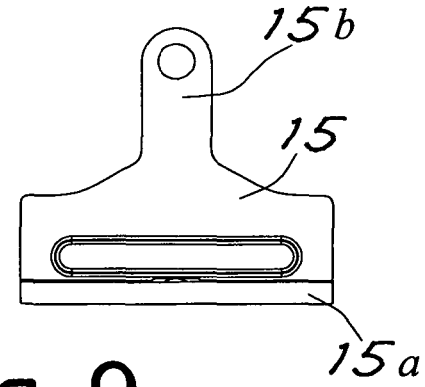
FIGS. 9 and 10 are views of the expansion tooth of the wing.
Figure 10:
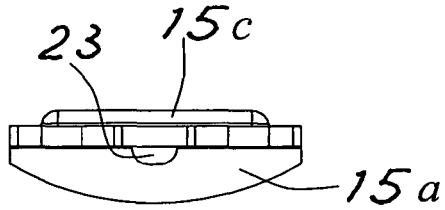

The tooth 15 (FIGS. 9 and 10) is generally L-shaped and comprises a hook 15*a* intended for being pressed against the side wall of the receiving hole 50 of the cup to fix to the component of the furniture. The tooth also comprises an upper arm 15*b* provided with a hole for being articulated on the eccentric lever 14 by means of the pivot 41 (FIG. 2).

In the lower part, near the hook 15*a*, the tooth 15 comprises a protrusion 15*c*, intended as will be seen for cooperating with the cam element 19 to cause the tooth to expand during the fixing step. The tooth 15 is further provided with a hole 23 at the "L" knee, intended for receiving a protrusion engagement of the elastic element 17.

The tooth 16 is made in a similar manner to the tooth 15.

Figure 6:
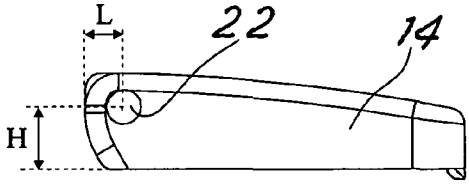
FIG. 6 is a side view of the eccentric lever of the wing.

The two teeth 15 and 16 are articulated on the eccentric lever 14 by the pivots 40 and 41. The upper arms 15*b*, 16*b* of the teeth 15, 16 protrude above the flange 13 of the cup, passing through suitable openings formed in the flange. The eccentric lever 14, clearly shown in FIG. 6, is hinged on the teeth 15, 16 at the height of the hole 22. This hole has a distance "H" from the lower face of the lever that is greater than the distance "L" from the end of the lever.

Figure 3:
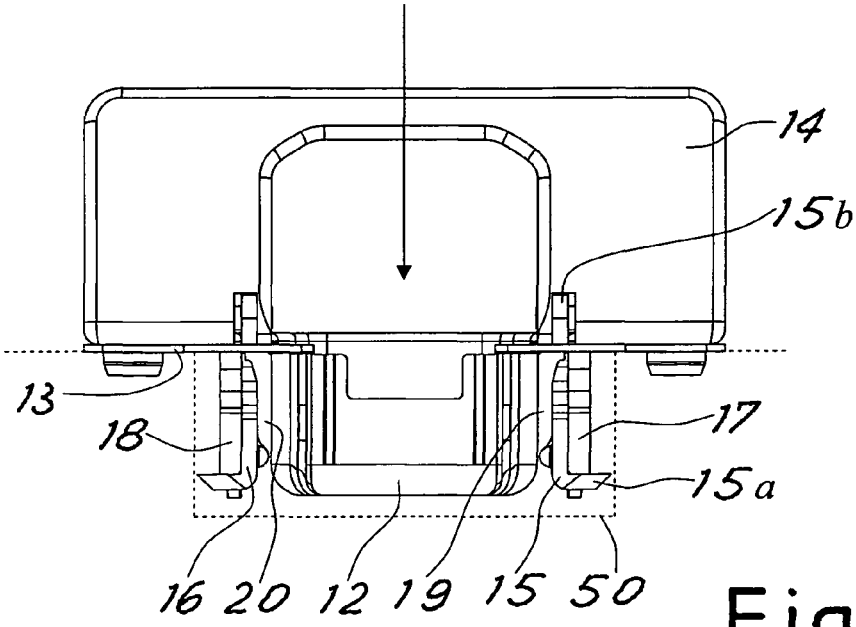
FIG. 3 is a frontal view of the wing in FIG. 1 during the step of mounting on the furniture.
Figure 4:
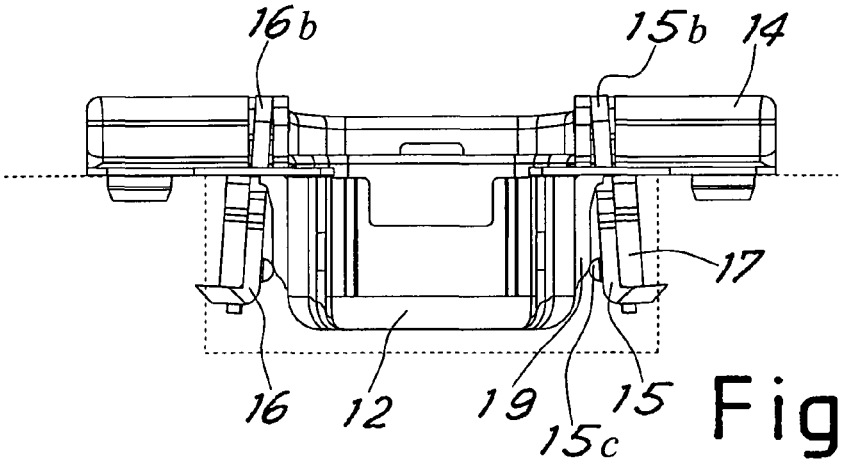
FIG. 4 is a frontal view that is similar to the previous view with the wing clamped on the furniture component.

In this manner, by taking the lever 14 from the vertical position of FIG. 1 to the horizontal position resting on the flange of the cup 12, the teeth 15, 16 are moved in a direction opposite the direction of inserting of the cup 12 into the receiving hole 50, as shown by FIGS. 3 and 4.

Figure 5:
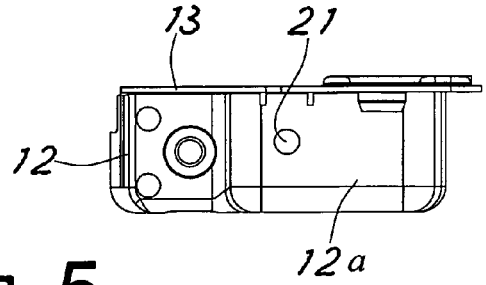
FIG. 5 is a side view of the cup of the wing.
Figure 11:
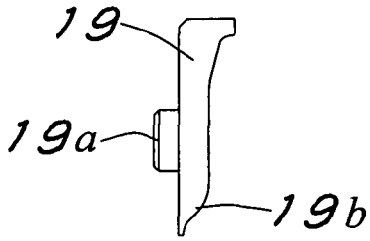
FIGS. 11 and 12 are views of the cam element of the wing.
Figure 12:
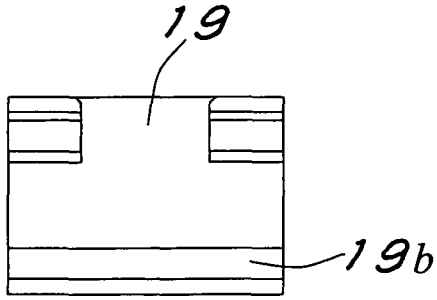
Figure 13:
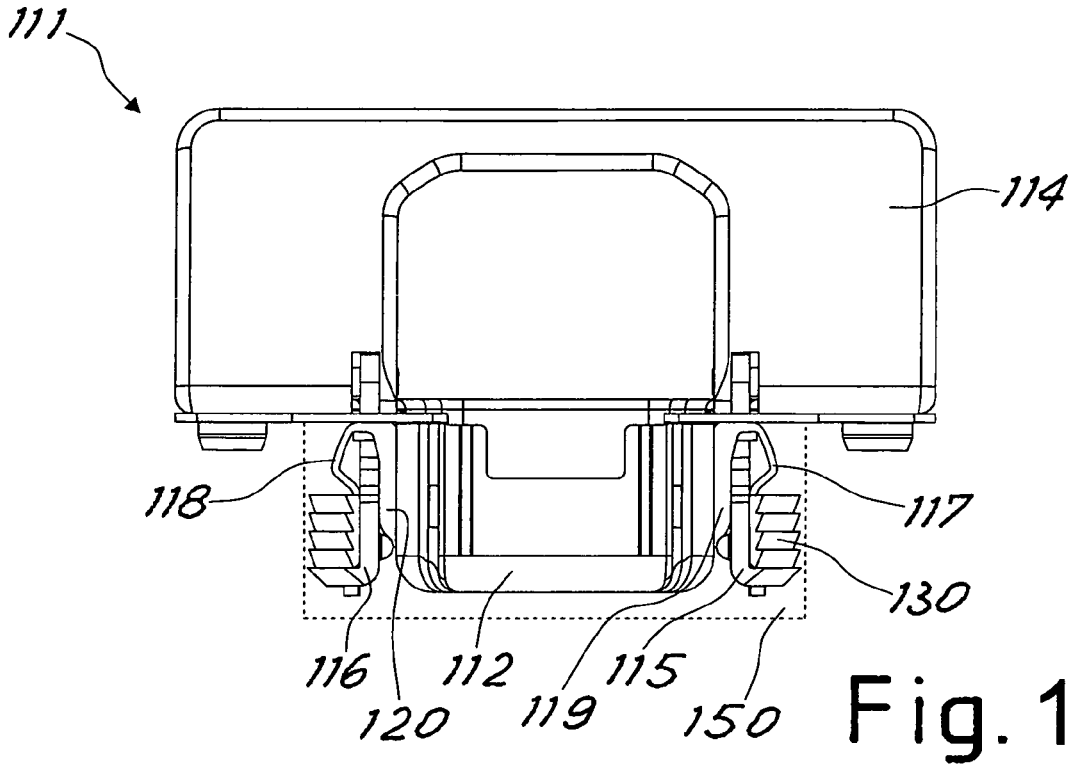
FIG. 13 is a frontal view of an alternative embodiment of a hinge wing according to the invention.
Figure 14:
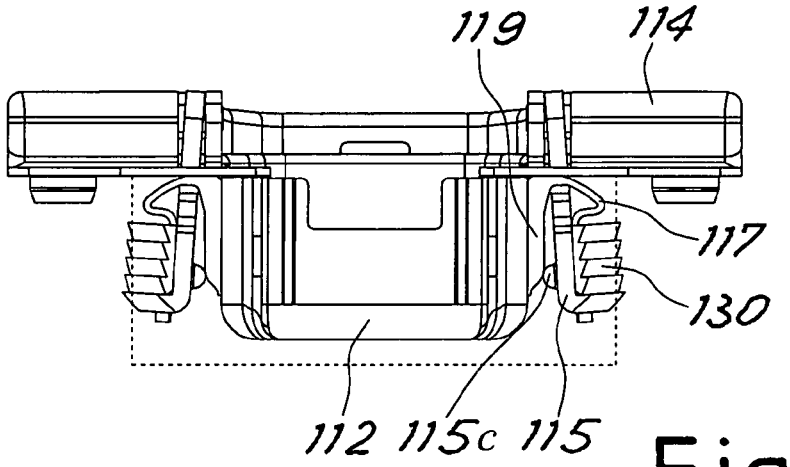
FIG. 14 is a frontal view that is similar to the previous view with the wing configured for clamping to the furniture.

Between the tooth 15 and the external side wall 12*a* of the cup 12 (shown in FIG. 5) there is provided a cam element 19 (also shown in FIGS. 11 and 12). The cam element 19 is fixable to the wall 12*a* of the cup by the protrusion 19*a* insertable into the hole 21 (FIG. 5) formed on the cup.

The cam element 19 has a shaped end 19*b*, that forms a tilted cam surface to command expansion of the tooth 15 when the latter is raised as shown in FIG. 4 through the action of the rotatingly lowered eccentric lever 14. The cam element is made of yieldable material to enable the cup to be tightened both in the case of a furniture component made of hard material (for example solid wood) and in the case of furniture made of soft material (for example chipboard), as will be re-examined below.

A cam element 20 that is similar to the element 19 is positioned between the tooth 16 and the opposite external side wall of the cup 12.

The hinge wing also comprises two elastic elements 17, 18 acting between the flange 13 and respectively the tooth 15 and the tooth 16. The elements 17, 18 are arranged in use between the teeth and the side wall of the hole 50 receiving the cup and act between the flange 13 and the lower hook of the respective tooth.

Figure 7:
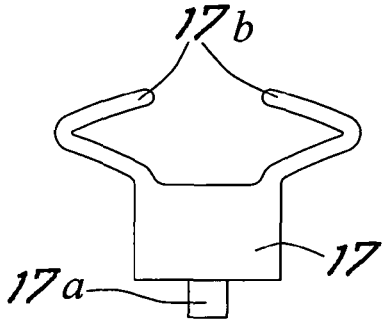
FIGS. 7 and 8 show views of the elastic element acting between the expandable tooth of the wing and the flange of the cup.
Figure 8:
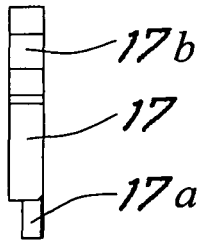

Preferably, the elastic element 17 (FIGS. 7 and 8) has a pair of elastic folded arms 17*b*, protruding above and intended for contact with the flange 13. The element 17 has a protrusion 17*a* below intended for being inserted in the opening 23 of the tooth, to maintain the element 17 in the correct position next to the tooth.

The elastic elements 17, 18 have the function of ensuring that the tooth is in the lowered position for inserting the cup 12 into the hole 50 when the eccentric lever 14 is in the raised position, maintaining the lever 14 constantly in contact with the flange 13.

The operation of the hinge wing during the fixing step of fixing the furniture component to the hole 50 is now disclosed.

Initially, the hinge wing is inserted into the hole 50 in the direction of the arrow shown in FIG. 3, with the eccentric lever 14 in a raised position and the flange 13 resting on the edge of the hole 50.

The eccentric lever 14 is thus rotated in a lowered position against the flange 13 (FIGS. 2 and 4), and the teeth 15, 16 are dragged upwards, in a direction opposite that of the insertion of the cup 12 into the hole 50.

The protrusion 15*c* of the tooth 15 slides on the cam 19, in particular on the lower side 19*b* thereof, so that the tooth 15 is pushed to expand away from the cup 12. The tooth 15 thus perforates the side wall of the hole 50 and, similarly, the tooth 16 perforates the side wall of the hole 50 on the opposite side (FIG. 4). The two teeth 15, 16 further cause downward traction of the flange 13 of the cup 12. In this manner the cup is fixed to the furniture.

Owing to the yieldability of the cam element 19, made for example of plastics, the necessary force for performing the fixing does not increase excessively in the case of material of the component of the hard furniture.

In fact, the greater resistance provided by the harder material of the door of the piece of furniture can be compensated by partial deformation of the end part 19*b* of the element 19: in this manner the penetration of the end part 15*c* of the tooth 15 is reduced and the force necessary for driving the lever 14 will be only a little greater than in the case of fixing in a softer material. In terms of strength, the lesser penetration of the teeth 15, 16 will be compensated by the greater resistance of the material of the door.

A hinge wing has thus been made that is provided with a fixing system that enables the designer to provide theoretical interference between the teeth and the door by quite a great amount, which will be used entirely in the case of doors (or other furniture elements) formed by a soft material and that will be used only partially in the case of more resistant materials, ensuring the end user has strength and fixing force that are similar even in the case of completely different materials.

In FIGS. 13-16 there is shown an alternative embodiment of the invention, where the elements corresponding to elements of the first embodiment are indicated by a reference number increased by 100.

Figure 15:
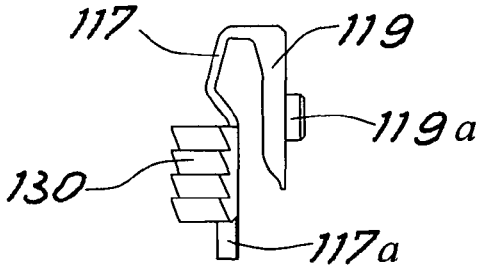
FIGS. 15 and 16 show views of the elastic element acting between the tooth and the flange of the cup of the wing, provided with a cam element.
Figure 16:
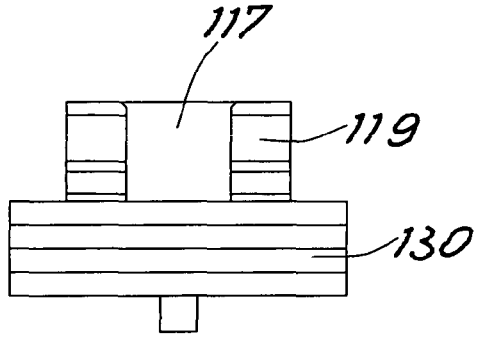

This second embodiment differs from the first embodiment by the fact that the elastic element 117 is formed by a single piece with the cam element 119, as well shown in FIGS. 15, 16. The two parts 117, 119 are connected together by thin tabs made with a shape and thickness that are such as to yield easily, enabling mutual movement when the eccentric lever 114 is rotated and the tooth 115, 116 is raised. The part 119 also has a pivot 119*a* that is insertable into a hole on the wall of the cup 112 to be fixed integrally therewith. The part 117 has a protrusion 117*a* at the end thereof that is engageable in a respective hole on the hook of the tooth.

In order to increase the strength, advantageously the part 117 has a toothed external profile 130 that, when the lever is lowered, partially penetrates inside the wall of the hole 150, contributing to achieve the strength thereof.

At this point it is clear how the objects of the present invention are achieved.

In particular, a hinge wing is provided that can be mounted rapidly and simply in a hole obtained in a furniture component without the use of tools.

The wing can be applied in a reliable manner to the furniture both in the case of a soft material (such as chipboard) and in the case of a hard material (like solid wood), without requiring excessive force from the user in the case of harder and more resistant material.

Further, the wing has a simple and cheap structure.

Naturally, the description made above of an embodiment applying the innovative principles of the present invention is given by way of example of such innovative principles and must not therefore be taken to limit the scope of what is claimed herein.

What is claimed is:

1. Hinge wing comprising a cup for fixing in a receiving hole of a furniture component, a pair of expandable teeth arranged outside of the cup on opposite sides of the cup and movable in a direction parallel to a direction of insertion of the cup into the receiving hole of the furniture component, an eccentric lever rotatable relative to the cup between a position suitable for insertion of the cup into the receiving hole and a position suitable for fixing the cup in the receiving hole and said eccentric lever being hinged to the teeth so that, upon a rotation of the eccentric lever relative to the cup from the position suitable for insertion of the cup into the receiving hole to the position suitable for fixing the cup in the receiving hole, the teeth undergo a movement in a direction opposite to the direction of insertion of the cup into the receiving hole from a rest position suitable for insertion of the cup into the receiving hole to an operative position suitable for fixing the cup in the receiving hole; and a cam for each tooth that, upon said movement of the respective tooth caused by said rotation of the eccentric lever, causes the tooth to expand away from the cup towards a side wall of the receiving hole to fix the cup to the furniture component, and each cam being formed with a cam element of yieldable material interposed between a side wall of the cup and the respective tooth.

2. Hinge wing according to claim 1, wherein the cam element is made of plastics.

3. Hinge wing according to claim 1, wherein each cam element is fixable to an external side wall of the cup.

4. Hinge wing according to claim 1, further comprising elastic thrusting means acting between each tooth and a flange protruding laterally from the cup to maintain the teeth in said rest position when the eccentric lever is in the insertion position.

5. Hinge wing according to claim 4, wherein said elastic thrusting means includes for each tooth a thrusting element interposed in use between the tooth and the side wall of the receiving hole of the cup.

6. Hinge wing according to claim 5, wherein said elastic thrusting element forms one piece with the cam element.

7. Hinge wing according to claim 5, wherein said elastic thrusting element is provided with external toothing suitable for being pressed against the side wall of the receiving hole of the cup when the teeth are made to expand by the eccentric lever.

8. Hinge wing according to claim 5, further comprising engaging means between said elastic thrusting element and the respective tooth.

9. Hinge wing according to claim 4, wherein each tooth is provided with an arm that passes through the flange of the cup, the eccentric lever is articulated on said arm above the flange.

10. Hinge wing according to claim 4, further comprising for each tooth thrusting elastic elements acting between the flange of the cup and a hook-shaped end of the respective tooth.

11. Hinge wing according to claim 1, wherein each tooth has a hook-shaped end intended for perforating the wall of the receiving hole of the cup.

* * * * *